US006336015B1

(12) United States Patent
Numagami

(10) Patent No.: US 6,336,015 B1
(45) Date of Patent: Jan. 1, 2002

(54) DEVELOPING APPARATUS WITH REGULATING MEMBER SEAL MEMBER AND MAGNETIC SEAL MEMBER

(75) Inventor: Atsushi Numagami, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/629,094

(22) Filed: Jul. 31, 2000

(30) Foreign Application Priority Data

Aug. 2, 1999 (JP) ..... 11-218437

(51) Int. Cl.[7] ..... G03G 15/08
(52) U.S. Cl. ..... 399/104; 399/105
(58) Field of Search ..... 399/102, 103, 399/104, 105

(56) References Cited

U.S. PATENT DOCUMENTS 5,068,691 A * 11/1991 Nishio et al. ..... 399/284
5,073,797 A * 12/1991 Ono et al. ..... 399/105
6,021,291 A 2/2000 Karakama et al. ..... 399/104
6,032,012 A * 2/2000 Hirono et al. ..... 399/103 X
6,038,414 A * 3/2000 Inami et al. ..... 399/104
6,044,237 A 3/2000 Numagami et al. ..... 399/104

* cited by examiner

*Primary Examiner*—Quana M. Grainger
(74) *Attorney, Agent, or Firm*—Fitzpatrick, Cella, Harper & Scinto

(57) ABSTRACT

A developing apparatus includes a developing frame and a developer carrying member provided in the developing frame, for carrying a developer to a developing position for developing an electrostatic image formed on an image bearing member by the developer. A regulating member is provided in the developing frame, for regulating a thickness of the developer carried on the developer carrying member. A regulating member seal member is provided for sealing a gap between the regulating member and the developing frame, and magnetic seal members opposed to a peripheral surface of lengthwise end portions of said developer carrying member. Magnetic portions of the magnetic seal members are formed so as to extend from portions in which the magnetic seal members are opposed to the developer carrying member to potions in which the magnetic seal members are opposed to the lengthwise end portions of the regulating member seal member.

16 Claims, 8 Drawing Sheets

DEVELOPING APPARATUS WITH REGULATING MEMBER SEAL MEMBER AND MAGNETIC SEAL MEMBER

BACKGROUND OF THE INVENTION

1. Field of the Invention

This invention relates to a developing apparatus preferably for use in an image forming apparatus such as an electrophotographic copier, an electrophotographic printer, a facsimile apparatus or a word processor, or a process cartridge.

2. Related Background Art

In an electrophotographic copier or the like, a latent image formed on an electrophotographic photosensitive drum which is an image bearing member is developed into a visible image with a toner, and a developing apparatus for supplying the toner to the photosensitive drum is comprised of a developing frame containing the toner therein, and a developing roller which is a developer carrying member and a developing blade which is a developer regulating member mounted on the developing frame. The toner is fine powder, and as shown in FIG. 8 of the accompanying drawings, in order to prevent the toner from leaking through the gaps between the developing frame 50 and the developing roller 51, elastic members 52 such as felt or rubber for sealing the gaps between the developing frame 50 and the developing roller 51 in the lengthwisely opposite end portions of the developing roller 51 have been attached.

If the toner used is a magnetic toner having magnetism, instead of the elastic members 52, as shown in FIG. 9 of the accompanying drawings, magnetic seal members 53 each having an arcuate portion 53*a* opposed to the developing roller and formed of a magnetic material are mounted so as to provide a minute interval with respect to the developing roller, and the magnetic toner is attracted by a magnetic force to thereby prevent the leakage of the toner. These magnetic seal members 53 do not abut against the developing roller 51 and therefore, there is the advantage that it becomes possible to make the rotational torque of the developing roller 51 small and the assemblage of the magnetic seal members to the developing frame 50 becomes easy.

Also, in the developing apparatus, a developing blade for regulating the layer thickness of the toner borne on the developing roller 51 is mounted on the developing frame 50, and in order that the toner may not leak from the gap between this developing blade and the developing frame 50, as shown in FIGS. 9 and 10 of the accompanying drawings, a lower blade seal member 54 is mounted between the developing frame 50 and the developing blade (not shown). In a construction in which the gaps are sealed by the magnetic seal members 53, the lengthwise end portions of this lower blade seal member 54 and the magnetic seal members 53 are mounted with minute spacings h and i therebetween, and blade end portion seals 55 are mounted to prevent the toner from leaking through the minute gaps h and i when the developing blade is mounted.

The magnetic seal members 53 are such that only the arcuate portions 53*a* thereof opposed to the developing roller 51 are formed of a magnetic material and the straight portions 53*b* thereof opposed to the blade end portion seal members 55 and the lengthwise end portions of the lower blade seal member 54 have no magnetism. Therefore, to reliably prevent the leakage of the toner, it is necessary to enhance the dimensional accuracy of the minute spacings h and i.

The magnetic seal members 53, however, are rigid members and the developing frame 50 on which they are mounted is also a rigid member and therefore, mounting backlash is liable to occur. Therefore, it has been necessary to effect the mounting of the seal members 53 especially carefully.

SUMMARY OF THE INVENTION

It is an object of the present invention to provide a developing apparatus in which the leakage of a developer is prevented without the mounting accuracy of magnetic seal members being enhanced.

It is another object of the present invention to

Further, in order to prevent the toner from leaking from between the developing blade 9*d* which is a developer regulating member and the developing frame 12 when the developing blade 9*d* is mounted, as shown in FIGS. 4 and 5, a lower blade seal member 16 of urethane or like material is stuck on the developing blade mounting position of the developing frame 12 with substantially the same length as the length of the developing blade 9*d,* and the developing blade 9*d* is mounted thereon. The magnetic seal members 14 are mounted so that the straight portions 14*b* thereof may be opposed with minute gaps h and i from the lengthwise end portions of the lower blade seal member 16. Also, blade end portion seal members 17 are mounted to prevent the toner from leaking from the minute spacings h and i when the developing blade 9*d* is mounted.

The straight portions 14*b* of the magnetic seal members 14 are mounted so as to be opposed to the lengthwise end portions of the lower blade seal member 16 and the blade end portion seal members 17 with the minute gaps h and i. The magnetic seal members 14 have magnetic portions formed not only on the arcuate portions 14*a* but also on the straight portions 14*b* and therefore, a magnetic force acts also on the gaps h and i. Therefore, the magnetic toner in the gaps h and i is attracted by the aforementioned magnetic force and it never happens that the toner leaks from the gaps h provide a developing apparatus in which the developer leakage preventing effect of magnetic seal members is extended to the vicinity of a regulating member.

Further objects and features of the present invention will become more fully apparent from the following detailed description when read with reference to the accompanying drawings.

DESCRIPTION OF THE PREFERRED EMBODIMENTS

An embodiment in which the present invention is applied to a laser beam printer which is an electrophotographic image forming apparatus will hereinafter be specifically described as a developing apparatus and a process cartridge provided with the same and an example of an image forming apparatus provided with the same with reference to the drawings.

Here, the electrophotographic image forming apparatus is an apparatus for forming an image on a recording medium by the use of the electrophotographic image forming method. Examples of the electrophotographic image forming apparatus cover an electrophotographic copier, an electrophotographic printer such as a laser beam printer or an LED printer, a facsimile apparatus and a word processor.

Also, the process cartridge refers to at least one of charging means, developing means and cleaning means and an electrophotographic photosensitive drum which is an image bearing member integrally made into a cartridge which is detachably mountable with respect to the main body of the image forming apparatus.

Figure 4:
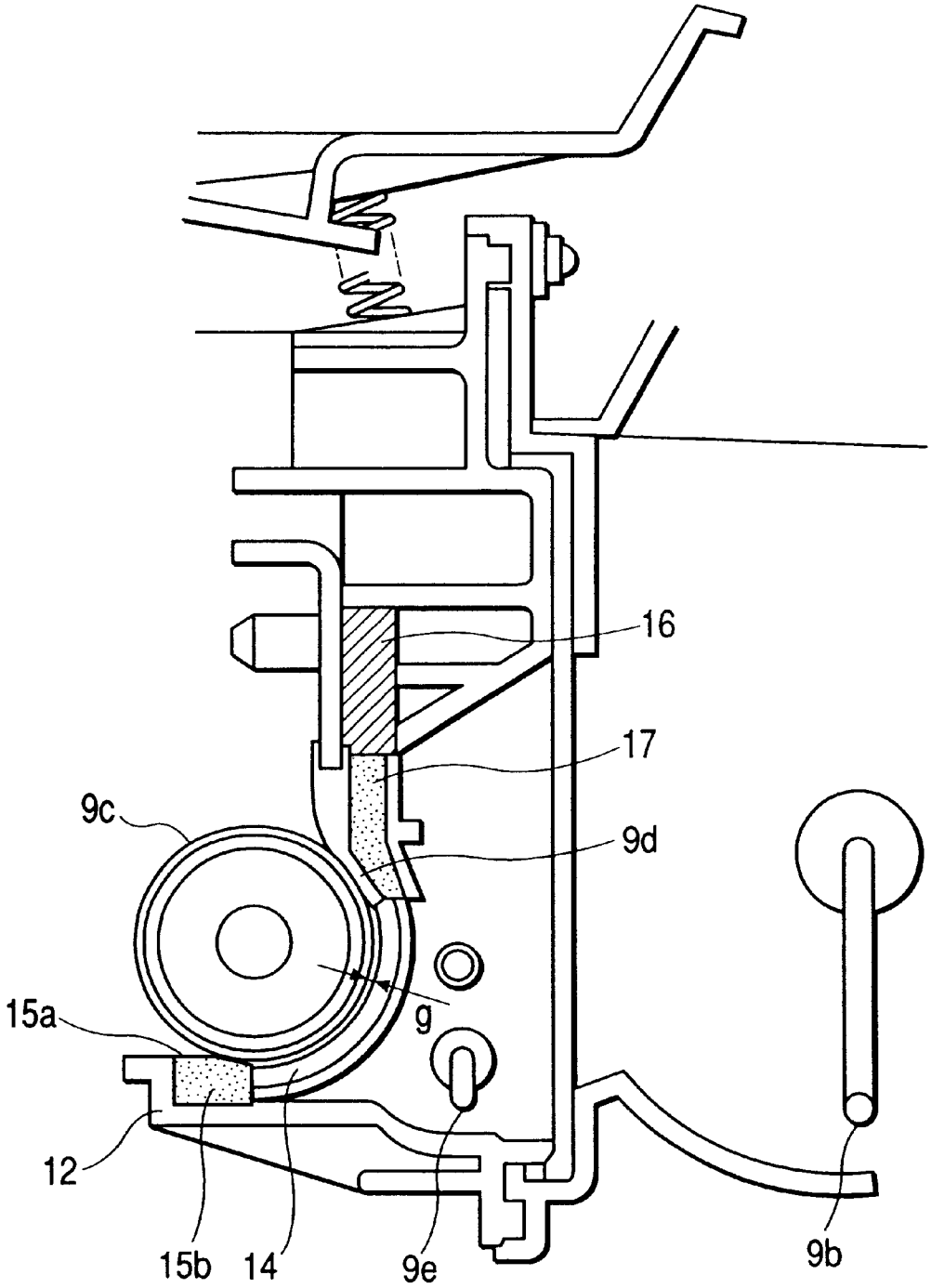
FIG. 4 is a side cross-sectional illustration showing a lower blade seal member and a blade end portion seal member.
Figure 5:
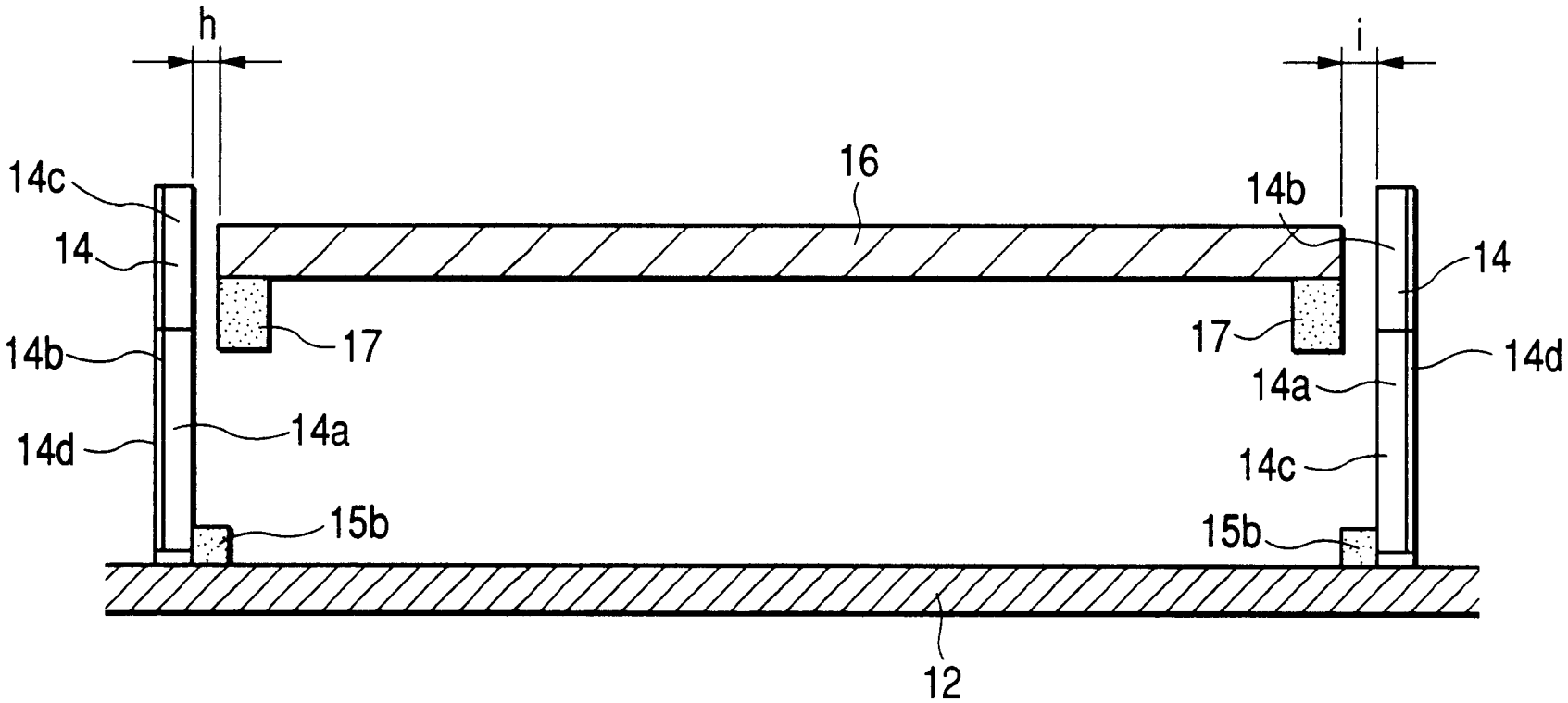
FIG. 5 is a illustration of the seal construction with the developing roller removed as it is seen from a photosensitive drum side.
Figure 6:
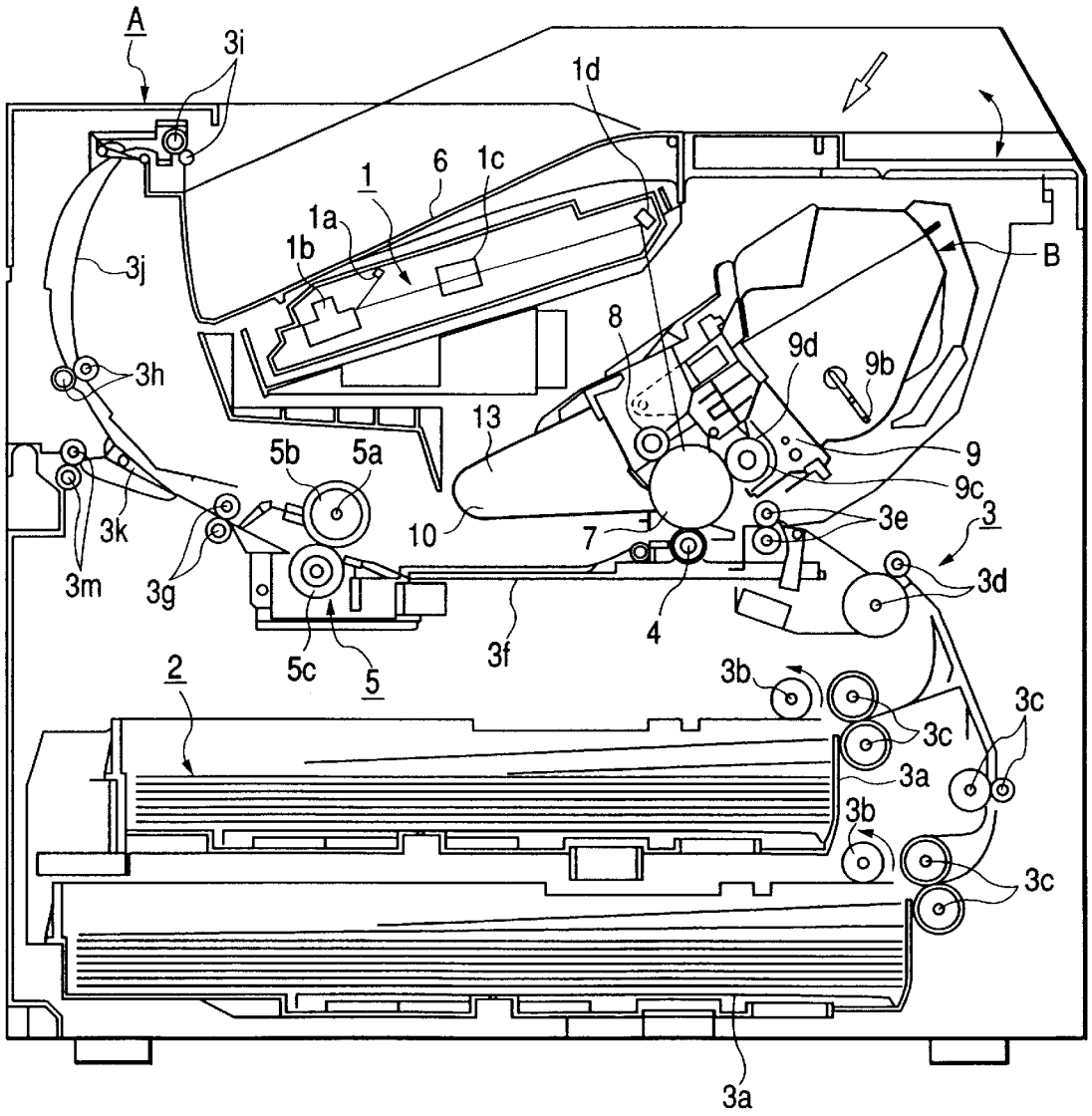
FIG. 6 is a general typical illustration of an image forming apparatus.
Figure 7:
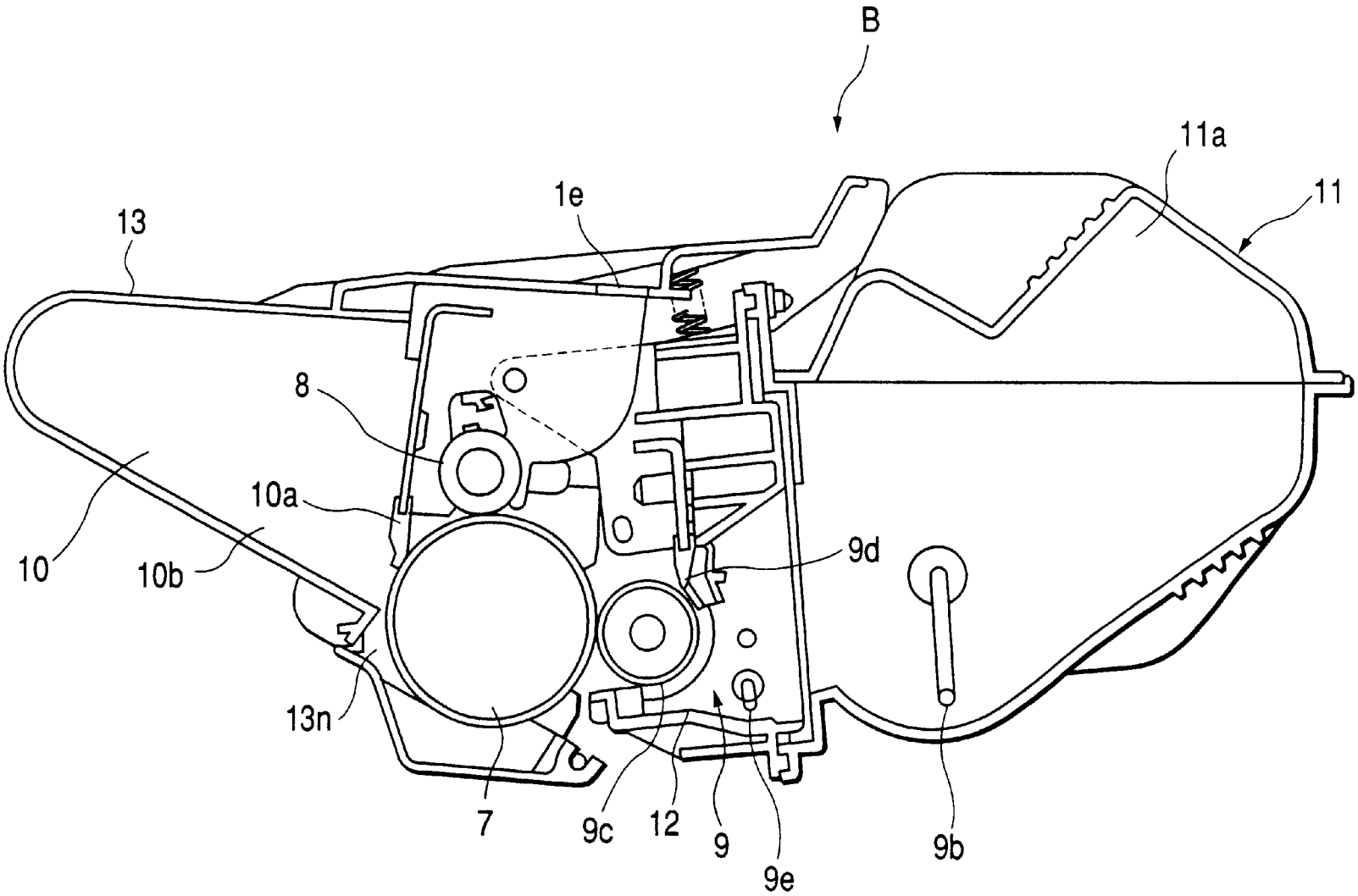
FIG. 7 is a typical illustration of a process cartridge.
Figure 8:
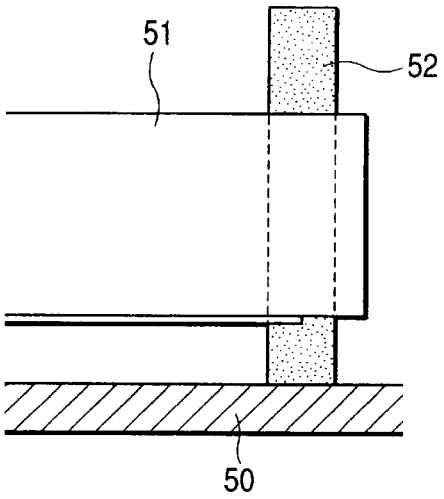
FIG. 8 is an illustration of a non-magnetic seal construction according to the prior art.
Figure 10:
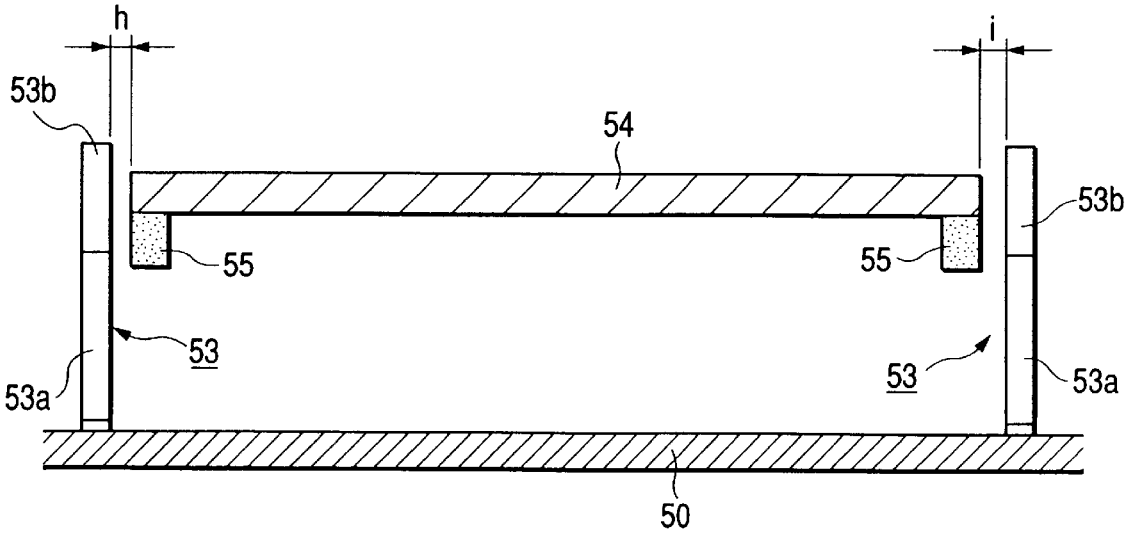
FIG. 10 is an illustration of the magnetic seal construction according to the prior art.
Figure 9:
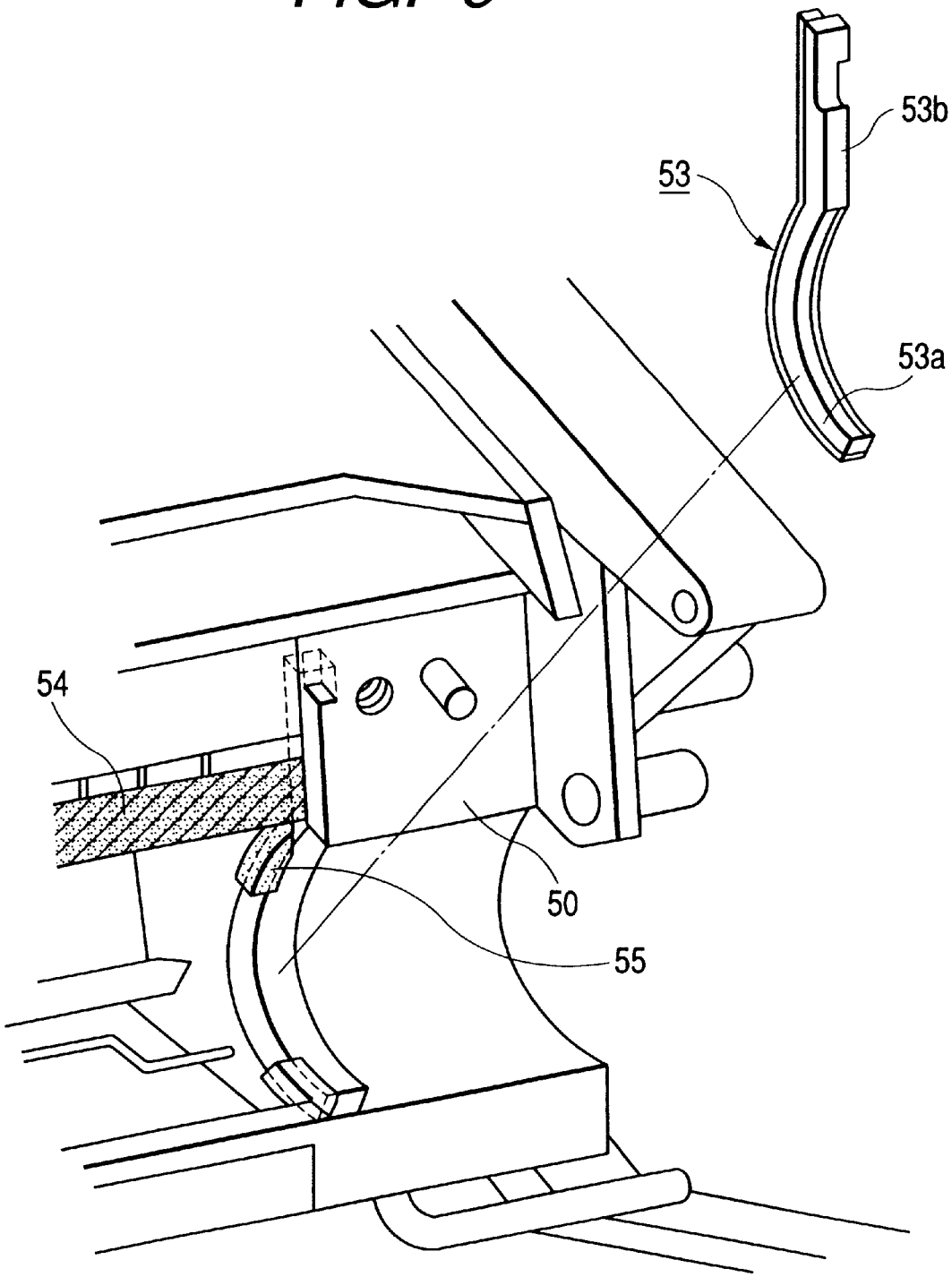
FIG. 9 is an illustration of a magnetic seal construction according to the prior art.

FIGS. 1 to 5 are illustrations of the toner seal construction of a developing apparatus, FIG. 6 is a general typical illustration of an image forming apparatus, and FIG. 7 is a typical illustration of a process cartridge.

In the following description, the upper surface of the process cartridge is a surface lying above in a state in which the process cartridge is mounted in the main body of the image forming apparatus, and the lower surface of the process cartridge is a surface lying below in the state in which the process cartridge is mounted in the main body of the image forming apparatus. Also, the left or right with respect to the process cartridge is the left or right opposite the conveyance direction of a recording medium when the process cartridge is seen from above it.

Also, the widthwise direction of the process cartridge is a direction in which the process cartridge is mounted and dismounted with respect to the main body of the image forming apparatus, and coincides with the conveyance direction of the recording medium. Also, the lengthwise direction of the process cartridge is a direction intersecting with (substantially orthogonal to) the direction in which the process cartridge is mounted and dismounted with respect to the main body of the image forming apparatus, and is a direction parallel to the plane of the recording medium and intersecting with (substantially orthogonal to) the conveyance direction of the recording medium.

(General Construction)

Reference is first made to FIGS. 6 and 7 to describe a process cartridge provided with a developing apparatus and the general construction of an image forming apparatus having the same mounted therein.

In FIGS. 6 and 7, the image forming apparatus is for forming an image on a recording medium 2 comprising paper, synthetic resin or cloth by the electrophotographic image forming process. It forms a toner image on an electrophotographic photosensitive drum 7.

More particularly, the surface of the photosensitive drum 7 is charged by a charging roller 8 which is charging means, whereafter a laser beam conforming to image information is applied from an optical system 1 which is optical means to the photosensitive drum 7 to thereby form an electrostatic latent image conforming to the image information.

This electrostatic latent image is then developed by developing means 9 which is the developing apparatus to thereby form a toner image. In synchronism with the formation of the toner image, the recording medium 2 contained in a feeding cassette 3*a* is reversed and conveyed by a pickup roller 3*b,* pairs of conveying rollers 3*c* and 3*d* and a pair of registration rollers 3*e.*

Next, the toner image formed on the photosensitive drum 7 contained in the process cartridge B is transferred to the recording medium 2 by a voltage being applied to a transferring roller 4 which is transferring means. Thereafter, the recording medium 2 to which the toner image has been transferred is conveyed to fixing means 5 by a conveying guide 3*f.* This fixing means 5 has a driving roller 5*c* and a fixing roller 5*b* containing a heater 5*a* therein. The transferred toner image is then permanently fixed by subjecting the passing recording medium 2 to the heating and pressing process.

The recording medium 2 is conveyed by pairs of discharge rollers 3*g,* 3*h* and 3*i,* and is discharged onto a discharge tray 6 through a reversal path 3*j* in a face-down fashion. This discharge tray 6 is provided on the upper surface of the main body of the image forming apparatus A. A pivotally movable flapper 3*k* can also be operated to thereby discharge the recording medium 2 out of the apparatus by a pair of discharge rollers 3*m* without the intermediary of the reversal path 3*j* in a face-up fashion.

In the present embodiment, the pickup roller 3*b,* the pairs of conveying rollers 3*c* and 3*d,* the pair of registration rollers 3*e,* the conveying guide 3*f,* the pairs of discharge rollers 3*g,* 3*h* and 3*i* and the pair of discharge rollers 3*m* together constitute conveying means 3.

On the other hand, the process cartridge B, as shown in FIG. 7, is such that the photosensitive drum 7 having a photosensitive layer on the surface thereof is rotated and the surface thereof is uniformly charged by the application of a voltage to the charging roller 8 provided in contact with the photosensitive drum 7. This charging roller 8 is rotated following the rotation of the photosensitive drum 7.

Then, a laser beam conforming to the image information from the optical system 1 is applied to the photosensitive drum 7 through an exposure opening portion 1*e* to thereby form an electrostatic latent image. The optical system 1 has a laser diode 1*a,* a polygon mirror 1*b,* a lens 1*c* and a reflecting mirror 1*d.*

This electrostatic latent image is then developed by the developing means 9 by the use of a magnetic toner which is magnetic particles. The developing means 9 supplies the magnetic toner to the developing area of the photosensitive drum 7 to thereby develop the electrostatic latent image formed on the photosensitive drum 7.

Here, the developing means 9 feeds out the magnetic toner in a toner container 11*a* to a developing roller 9*c* by the rotation of a toner feeding member 9*b.* The developing roller 9*c* containing a fixed magnet therein is then rotated and a magnetic toner layer to which triboelectric charges have been imparted by a developing blade 9*d* is formed on the surface of the developing roller 9*c,* and the magnetic toner is supplied to the developing area (developing position) of the photosensitive drum 7.

The magnetic toner is then shifted to the photosensitive drum 7 in conformity with the electrostatic latent image to thereby visualize the latent image as a toner image. The developing blade 9*d* prescribes the amount of magnetic toner on the peripheral surface of the developing roller 9*c* and also imparts triboelectric charges. Also, a toner agitating member 9*e* for circulating the magnetic toner in a developing chamber is rotatably mounted near the developing roller 9*c.*

A voltage opposite in polarity to the toner image is applied to the transferring roller 4 to thereby transfer the toner image formed on the photosensitive drum 7 to the recording medium 2, whereafter any residual magnetic toner on the photosensitive drum 7 is removed by cleaning means 10. The cleaning means 10 scrapes off the residual magnetic toner on the photosensitive drum 7 by an elastic provided in abutting relationship with the photosensitive drum 7 and collects it into a waste toner reservoir 10*b*.

The process cartridge B is comprised of a toner frame 11 having the toner container 11*a* containing the magnetic toner therein and a developing frame 12 holding the developing means 9 including the developing roller 9*c*, etc., the toner frame 11 and the developing frame being coupled together, and further a cleaning frame 13 coupled thereto and mounting therein the photosensitive drum 7, the cleaning means 10 including the elastic cleaning blade 10*a*, etc., and the charging roller 8. This process cartridge B can be detachably mounted with respect to the mounting means of the main body of the image forming apparatus by an operator.

This process cartridge B is provided with an exposure opening portion 1*e* for applying therethrough a laser beam conforming to the image information to the photosensitive drum 7, and a transfer opening portion 13*a* to be opposed to the recording medium 2. The exposure opening portion 1*e* is provided in the cleaning frame 13, and the transfer opening portion 13*a* is formed between the developing frame 12 and the cleaning frame 13.

(Seal Construction of the Developing Apparatus)

Figure 1:
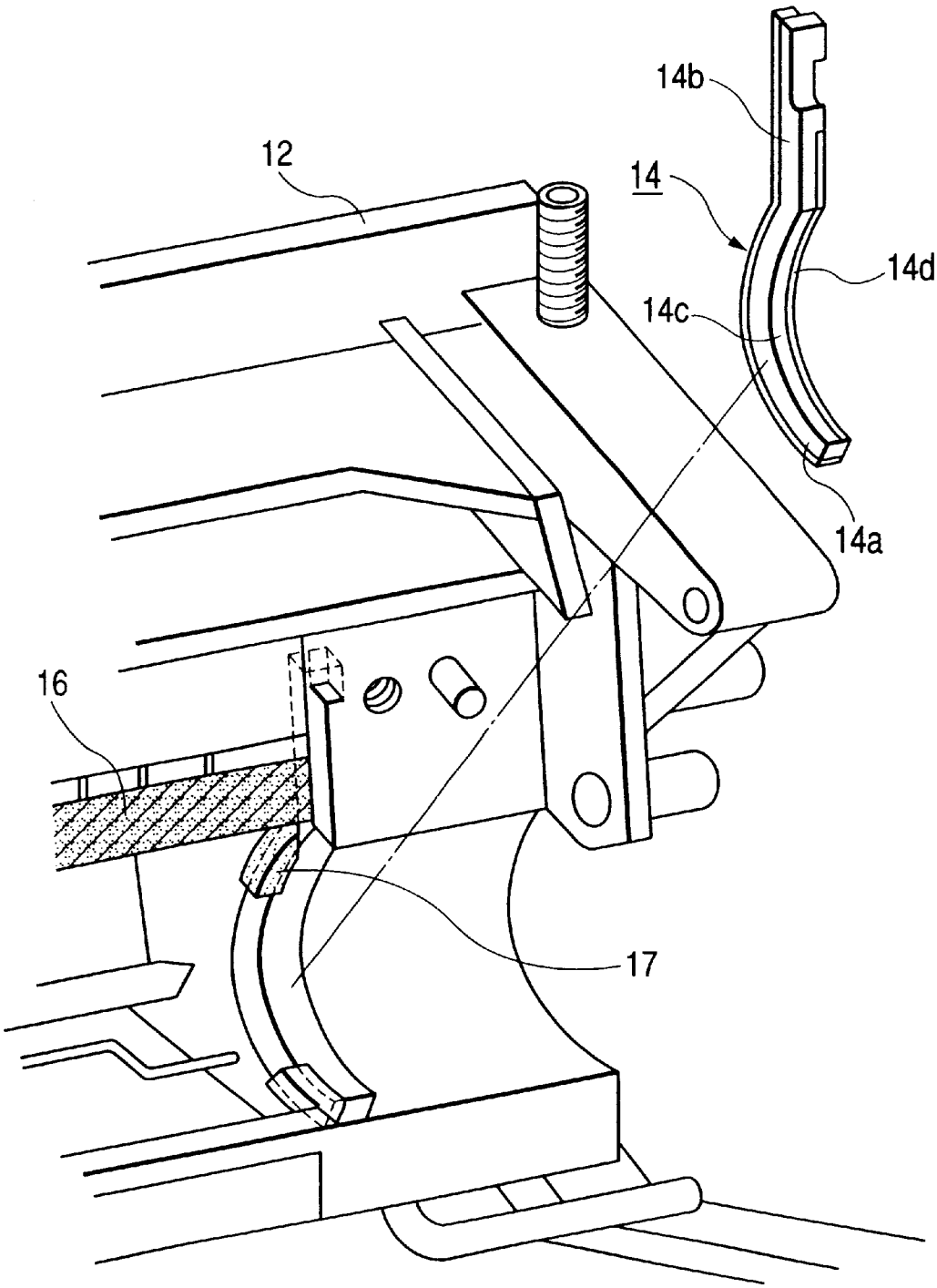
FIG. 1 is a perspective illustration of a seal construction showing a lengthwise end portion of a developing roller.
Figure 2:
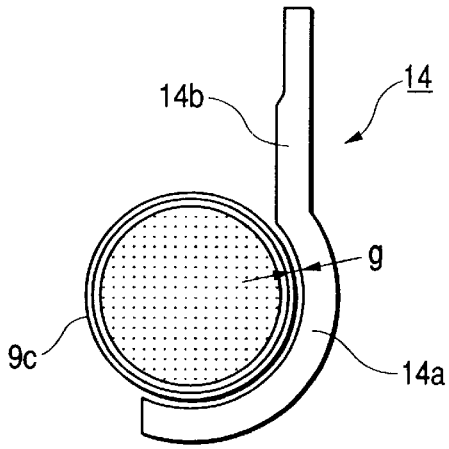
FIG. 2 is a side cross-sectional illustration of the seal construction by a magnetic seal member.
Figure 3:
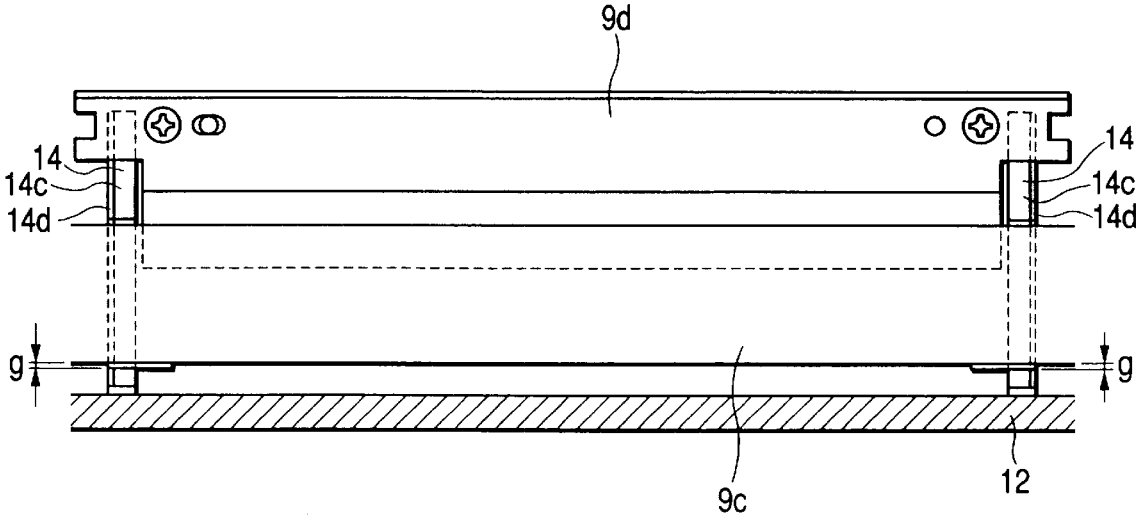
FIG. 3 is an illustration showing the interval between the developing roller and the magnetic seal member.

The seal construction for the magnetic toner around the developing roller 9*c* which is a developer carrying member will now be described in detail with reference to FIGS. 1 to 5. FIG. 1 is a perspective illustration of the seal construction showing the lengthwise end portion of the developing roller, FIG. 2 is a side cross-sectional illustration of the seal construction by a magnetic seal member, and FIG. 3 is an illustration showing the spacing between the developing roller and the magnetic seal member. FIG. 4 is a side cross-sectional illustration showing a lower blade seal member and a blade end portion seal member, and FIG. 5 is an illustration of the seal construction with the developing roller removed as it is seen from the photosensitive drum side.

As shown in FIG. 1 (which shows one lengthwise end side of the developing frame with the developing roller and the developing blade removed therefrom), magnetic seal members 14 for preventing the leakage of the magnetic toner from the lengthwisely opposite end portions of the developing roller 9*c* are provided at these end portions. Each of these magnetic seal members 14 comprises an arcuate portion 14*a* opposed to the peripheral surface of the developing roller 9*c*, and a straight portion 14*b* extended from the arcuate portion 14*a* and attached to the developing frame 12, and as shown in FIG. 2, it is attached to the developing frame 12 with the arcuate portion 14*a* disposed with a minute spacing (gap) g between itself and the outer peripheral surface of the developing roller 9*c*.

Also, the magnetic seal member 14, as shown in FIG. 1, has a magnetic plate 14*d* which is a magnetic member joined to the outer side of a magnet 14*c* in the lengthwise direction of the developing roller 9*c*, and the arcuate portion 14*a* and the straight portion 14*b* are given magnetism.

The magnetic seal member 14 will now be described in greater detail. The magnetic seal member 14 is such that the magnet 14*c* which is a constituent thereof is an injection molded article of a width 3 mm provided with a nylon binder containing magnetic powder of Nd—Fe—B, and the magnetic plate 14*d* which is another constituent is an iron member having a thickness of 1 mm.

The method of joining the magnet 14*c* and the magnetic plate 14*d* is provided by insert molding which is injection molding. However, it may also be an adhesive both-surface tape or attraction joint by only a magnetic force. Also, the minute spacing g between the developing roller 9*c* and the magnetic seal member 14 is 0.1 to 0.7 mm, and the magnetic flux density of the surface of the developing roller 9*c* by the then magnetic force of the magnetic seal member 14 is of the order of 1000 to 2000 gauss (Gs) ($1\times10^{-1}$ to $2\times10^{-1}$ T).

The positional relationship between the magnet 14*c* and the magnetic plate 14*d* in the magnetic seal member 14 is such that the magnet 14*c* is disposed lengthwisely inside the developing roller 9*c* and the magnetic plate 14*d* is disposed outside it.

Below the developing roller 9*c*, an elastic sheet 15*a* which is a sheet member of e.g. PET (polyethylene terephthalate), urethane or the like is provided along the lengthwise direction of the developing roller 9*c*, and the fore end portion thereof elastically abuts against the developing roller 9*c*. Further, the lengthwise end portions of this elastic sheet 15*a* overlap the magnetic seal members 14 within the ranges of the magnetic seal members 14 in the lengthwise direction of the developing roller 9*c*, and in these portions, the fore end portion of the elastic sheet 15*a* lies in the minute spacing g between the developing roller 9*c* and the magnetic seal members 14. The leakage of the toner from the lower portion of the developing roller 9*c* is prevented by this elastic sheet 15*a*.

Rubber sponge 15*b* which is an elastic member for helping the elastic sheet 15*a* abut against the developing roller 9*c* is provided on the developing frame 12 inwardly of the magnetic seal members 14 in the lengthwise direction of the developing frame 12 and under the elastic sheet 15*a*.

As described above, the gaps h and i are sealed by the magnetic seal members 14 and therefore, it becomes unnecessary to severely control the mounting dimensional accuracy of the magnetic seal members, and the assembling work therefor becomes easy.

With such a construction as previously described, the magnetic seal members are formed on the lengthwise end portions of the lower blade seal portion or magnetic portions are also formed on the portions opposed to the blade end portion seal members and therefore, even if the dimension of the gap between the two is not strict, the magnetic toner is sealed by the magnetic seal members and the leakage of the toner is prevented. Therefore, it becomes unnecessary to severely control the mounting dimensional accuracy of the magnetic seal members, and the assembling work therefor becomes easy.

What is claimed is:

1. A developing apparatus comprising:

a developing frame;

a developer carrying member provided in said developing frame, for carrying a developer to a developing position for developing an electrostatic image formed on an image bearing member with the developer;

a regulating member provided in said developing frame, for regulating a thickness of the developer carried on said developer carrying member;

a regulating member seal member for sealing a gap between said regulating member and said developing frame; and a magnetic seal member opposed to a peripheral surface of lengthwise end portion of said developer carrying member, a magnetic portion of said magnetic seal member being formed so as to extend from a first portion in which said magnetic seal member is opposed to said developer carrying member to a second portion in which said magnetic seal member is opposed to a lengthwise end portion of said regulating member seal member, said second portion being provided outside of said regulating member sealing member in a lengthwise direction of said developer carrying member.

2. A developing apparatus according to claim 1, wherein said developer carrying member is roller-shaped.

3. A developing apparatus according to claim 1, wherein said regulating member is blade-shaped.

4. A developing apparatus according to claim 1, further comprising an end portion seal member for sealing the lengthwise end portion of said regulating member, wherein said magnetic portion of said magnetic seal member is formed so as to extend to a portion in which said magnetic seal member is opposed to said end portion seal member.

5. A developing apparatus according to claim 1, further comprising an end portion seal member for sealing the lengthwise end portion of said regulating member, said end portion seal member being provided nearer to said developer carrying member than said regulating member seal member.

6. A developing apparatus according to claim 1, wherein said developer is provided with magnetic particles.

7. A developing apparatus according to claim 6, wherein said magnetic particles are a toner.

8. A developing apparatus according to claim 1, said developing apparatus constituting a process cartridge detachably attachable to an image forming apparatus together with said image bearing member.

9. A developing apparatus comprising:

a developing frame;

a developer carrying member provided in said developing frame, for carrying a developer to a developing position for developing an electrostatic image formed on an image bearing member with the developer;

a regulating member provided in said developing frame, for regulating a thickness of the developer carried on said developer carrying member;

end portion seal member for sealing lengthwise end portion of said regulating member; and a magnetic seal member opposed to a peripheral surface of the lengthwise end portion of said developer carrying member, a magnetic portion of said magnetic seal members being formed so as to extend from a first portion in which said magnetic seal member is opposed to said developing carrying member to a second portion in which said magnetic seal member is opposed to said end portion seal members, said second portion being provided outside of said end portion seal member in a lengthwise direction of said developer carrying member.

10. A developing apparatus according to claim 9, wherein said developer carrying member is roller-shaped.

11. A developing apparatus according to claim 9, wherein said regulating member is blade-shaped.

12. A developing apparatus according to claim 9, wherein said developer is provided with magnetic particles.

13. A developing apparatus according to claim 12, wherein said magnetic particles are a toner.

14. A developing apparatus according to claim 9, said developing apparatus constituting a process cartridge detachably attachable to an image forming apparatus together with said image bearing member.

15. A developing apparatus according to claim 1 or 8, wherein said magnetic seal member is provided with a magnet and a magnetic member adjacent to said magnet, extending from said first portion to said second portion.

16. A developing apparatus according to claim 15, wherein said magnetic member is provided outside of said magnet in the lengthwise direction of said developing carrying member.

* * * * *

UNITED STATES PATENT AND TRADEMARK OFFICE

CERTIFICATE OF CORRECTION

PATENT NO. : 6,336,015 B1
DATED : January 1, 2002
INVENTOR(S) : Atsushi Numagami It is certified that error appears in the above-identified patent and that said Letters Patent is hereby corrected as shown below:

Column 1,
Line 27, "lengthwisely" should read -- lengthwise --.

Column 2,
Lines 13 through 37, should be deleted;
Line 38, "h" should be deleted; and
Line 57, "a" should read -- an --.

Column 5,
Line 7, "elastic" should read -- elastic cleaning blade 10a --; and
Line 48, "lengthwisely" should read -- lengthwise --.

Column 6,
Line 10, "then" should be deleted;
Line 14, "lengthwisely" should read -- lengthwise --; and
Line 35, "sheet 15a." should read -- sheet 15a. --.

Further, in order to prevent the toner from leaking from between the developing blade 9d which is a developer regulating member and the developing frame 12 when the developing blade 9d is mounted, as shown in Figs. 4 and 5, a lower blade seal member 16 of urethane or like material is stuck on the developing blade mounting position of the developing frame 12 with substantially the same length as the length of the developing blade 9d, and the developing blade 9d is mounted thereon. The magnetic seal members 14 are mounted so that the straight portions 14b thereof may be opposed with minute gaps h and i from the lengthwise end portions of the lower blade seal member 16. Also, blade end portion seal members 17 are mounted to prevent the toner from leaking from the minute spacings h and i when the developing blade 9d is mounted.

UNITED STATES PATENT AND TRADEMARK OFFICE

CERTIFICATE OF CORRECTION

PATENT NO. : 6,336,015 B1
DATED : January 1, 2002
INVENTOR(S) : Atsushi Numagami It is certified that error appears in the above-identified patent and that said Letters Patent is hereby corrected as shown below:

The straight portions 14b of the magnetic seal members 14 are mounted so as to be opposed to the lengthwise end portions of the lower blade seal member 16 and the blade end portion seal members 17 with the minute gaps h and i. The magnetic seal members 14 have magnetic portions formed not only on the arcuate portions 14a but also on the straight portions 14b and therefore, a magnetic force acts also on the gaps h and i. Therefore, the magnetic toner in the gaps h and i is attracted by the aforementioned magnetic force and it never happens that the toner leaks from the gaps h and i --.

Signed and Sealed this

Fourteenth Day of May, 2002

*Attest:*

*Attesting Officer*

JAMES E. ROGAN
*Director of the United States Patent and Trademark Office*